US006104133A

United States Patent [19]

Aizawa et al.

[11] Patent Number: 6,104,133

[45] Date of Patent: Aug. 15, 2000

[54] NEON DISCHARGE LAMP WITH POWDER COATING

[75] Inventors: Masanobu Aizawa; Tomohiko Sakamoto; Masalu Ito; Tsuneyoshi Shibasaki, all of Iwaki, Japan

[73] Assignee: Stanley Electronics Co., Ltd., Tokyo, Japan

[21] Appl. No.: 09/073,456

[22] Filed: May 6, 1998

[30] Foreign Application Priority Data

May 9, 1997 [JP] Japan ..... 9-119423

[51] Int. Cl.[7] ..... H01J 61/24; H01J 61/26

[52] U.S. Cl. ..... 313/489; 313/486; 313/573; 313/635

[58] Field of Search ..... 313/485, 486, 313/489, 573, 576, 635, 643

[56] References Cited

U.S. PATENT DOCUMENTS

| | | | |
|---|---|---|---|
| 2,207,174 | 7/1940 | Jenkins | 313/573 |
| 3,121,183 | 2/1964 | Swanson | 313/485 |
| 4,396,863 | 8/1983 | Ranby et al. | 313/486 |
| 5,606,218 | 2/1997 | Cotter et al. | 313/485 |

*Primary Examiner*—Michael H. Day

*Attorney, Agent, or Firm*—Ostrolenk, Faber, Gerb & Soffen, LLP

[57] ABSTRACT

A neon discharge lamp provided with a powder coating with an appropriate particle size of used powder, is applied on an inner surface of a tubular bulb to the extent nearly equal to or more the length of an electrode portion, along the longitudinal axis of said tubular bulb. The phenomenon of neon gas being encompassed by way of cathode sputtering is prevented and the shortened operating life of the neon discharge lamp of this kind by way of cathode sputtering is also prevented.

5 Claims, 2 Drawing Sheets

NEON DISCHARGE LAMP WITH POWDER COATING

BACKGROUND OF THE INVENTION

1. Field of the Invention

The present invention relates to a neon discharge lamp, and more particularly to a neon discharge lamp of which the life of the lamp is extended and for use in an indicating lamp, an advertising lamp and the like utilizing a relatively long operating life provided thereto.

2. Background Art

FIG. 4 illustrates an exemplary configuration of a 15 conventional neon discharge lamp 90 of this kind. This neon discharge lamp 90 is comprised of a tubular bulb 91 and a pair of mounts 92 sealing respective ends thereof. The mount 92 is comprised of a plate electrode 92*a*, a nickel wire 92*b*, a Dumet wire 92*c* and a bead 92*d*. Neon gas 93 is sealed within the tubular bulb 91 at a pressure of about 100 Torr.

When an A.C. voltage is applied across the plate electrodes 92*a* of the neon discharge lamp 90 thus constructed, the neon discharge lamp is lit by gas discharge.

The plate electrode 92*a* includes ZrAl getters for adsorption of impurity gases generated during illuminating in order to prevent the operating life of the neon discharge lamp from being shortened.

There are some other Phenomena which shorten the operating life of the neon discharge lamp 90 other than the generation of the impurity gases aforementioned. There is a known process of cathode sputtering as schematically shown in FIG. 5. Fine particles 92*e* generated from the plate electrode 92*a* material by electric discharge sputter toward the inside wall of the tubular bulb 91 and are attached there. During this process, the pressure inside the tubular bulb 91 reduces, since some of neon gas 93 inside the tubular bulb 91 is encompassed by the fine particles 92*e* which are attached to the inside of the tubular bulb 91. Thus, the operating life of the neon discharge lamp is shortened.

Particularly, in the cathode sputtering mentioned above, if the gas pressure decreases, the sputtering of the plate electrode 92*a* material tends to increase, and, therefore, the amount of neon gas encompassed by the fine particles 92*e* increases even more. Thus, the decreasing of the gas pressure accelerates the sputtering of the plate electrode 92*a* material and shortens the operating life of the neon discharge lamp.

Furthermore, the electrode material thus sputtered and attached decreases the transparency of the tubular bulb 91, leading to the phenomenon of the so-called blackening. These phenomena leading to loss of lighting amount accelerate the shortening of the operating life of the neon discharge lamp.

For the conventional neon discharge lamp 90 mentioned above, measures have been taken only for the shortening of the operating life of the neon discharge lamp caused by impurity gases and no measures have been taken for the shortened life caused by the sputtering. Thus, the problem of the sputtering still remains to be solved and the need exists for an even longer operating life of the neon discharge lamp.

SUMMARY OF THE INVENTION

To solve the problems of the aforementioned prior art, the present invention provides a neon discharge lamp comprising a tubular bulb and electrode portions provided at respective ends thereof, in which powder coating with an appropriate particle size of used powder is applied on the predetermined portion inside of said tubular bulb.

Also, the present invention provides the neon discharge lamp, in which said powder coating comprises luminescent material used for a luminescent lamp.

In said neon discharge lamp, preferably, the powder coating is applied on the inner surface of said tubular bulb to the extent nearly equal to or more the length of said electrode portion, along the longitudinal axis of said tubular bulb.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

The present invention is described in detail hereinafter with reference to embodiment shown in the accompany drawings.

Figure 1:
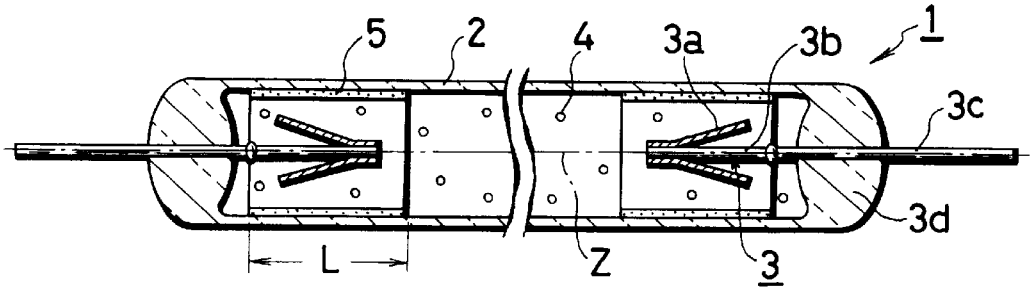
FIG. 1 is a cross-sectional view of an embodiment of a neon discharge lamp according to the present invention.

FIG. 1 illustrates a neon discharge lamp 1 according to the present invention. This neon discharge lamp 1 is comprised of a tubular bulb 2 and a pair of mounts 3 for sealing respective ends of the tubular bulb. Each mount 3 is comprised of an electrode portion 3*a* in the form of a plate electrode, a nickel wire 3*b*, a Dumet wire 3*c* and a bead 3*d*. Neon gas 4 is sealed within the tubular bulb 2 at a pressure of about 100 Torr.

According to the present invention, powder coating 5 is applied on the inner surface of the tubular bulb 2. This powder coating 5 is formed in such a way that powder 5*a* with an appropriate particle size is bound with an appropriate amount of a binder. The powder coating 5 thus prepared is coated on the inner surface of the tubular bulb, and then fixed thereon by baking it or the like. The powder coating 5 in this state is highly porous. That is, it is rich in interstices.

The range L of the powder coating 5 to be formed need not cover entire inner surface of the tubular bulb 2, but may just cover the surface nearly equal to or more the length of the electrode portion 3*a*, along the axis Z of the tubular bulb 2. In other words, the powder coating may just cover the inner surface of the tubular bulb such that the electrode portions cannot be seen when looking the tubular bulb 2 from the direction perpendicular to axis Z. Also, preferably the range L does not affect substantially the effective illuminating range of the neon discharge lamp 1.

The result of the experiments made by the inventors to accomplish the present invention shows that the powder for forming the powder coatings is effective when the powder has particle size in the range from about 5 to about 10 $\mu$m and has an irregular particle form. However, when employing the particles that have never been used to be sealed in the discharge lamp of this kind, care must be taken in their influence on the operating life of the lamp.

Further, the powder is selected from compounds that do not affect discharge emission when sealed inside the lamp. Preferably, the powder used according to the present invention is one selected from luminescent materials that have commonly be used to coat inside a luminescent lamp over the years because those materials suitably meet the conditions mentioned above. In an embodiment according to the present invention, luminescent materials specifically mentioned above are used as the powder for forming the powder coatings. However, unlike those used in the luminescent lamp, it is not necessary to specify emission colors, because light emission from the luminescent materials is not expected.

The action and effect of the neon discharge lamp 1 according to the present invention constructed as mentioned above will be discussed herein. While the neon discharge lamp 1 is lit, fine particles 3*e* generated from the electrode portion 3*a* material sputters. The cathode sputtering; occurs even in the neon discharge lamp 1 according to the present invention much the same as the conventional lamp.

Figure 2:
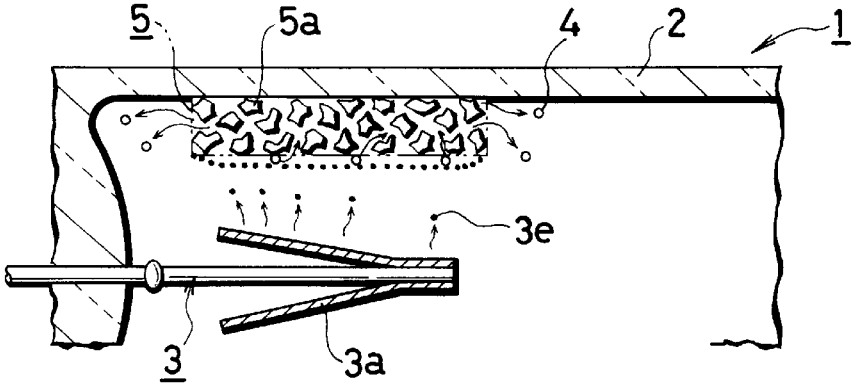
FIG. 2 is an explanatory drawing showing the action of the embodiment shown in FIG. 1.

As shown in FIG. 2, in an embodiment according to the present invention in which powder coatings 5 are formed near the respective electrode portions 3*a*, most of the scattered fine particles 3*e* of the electrode portions 3*a* reach the powder coatings 5 and are attached thereon. Since the particle size of the powder 5*a* which forms the powder coatings is much larger than the fine particles 3*e* of the electrode portions 3*a*, the interstices among the powder 5*a* are not plugged immediately.

Accordingly, neon gas encompassed by the fine particles 3*e* of the electrode portions 3*a* can return as useful gas to the inside of the tubular bulb 2 by way of the interstices inside the powder coatings 5. As a result, the neon gas 4 encompassed by way of the cathode sputtering can be reduced significantly.

Figure 3:
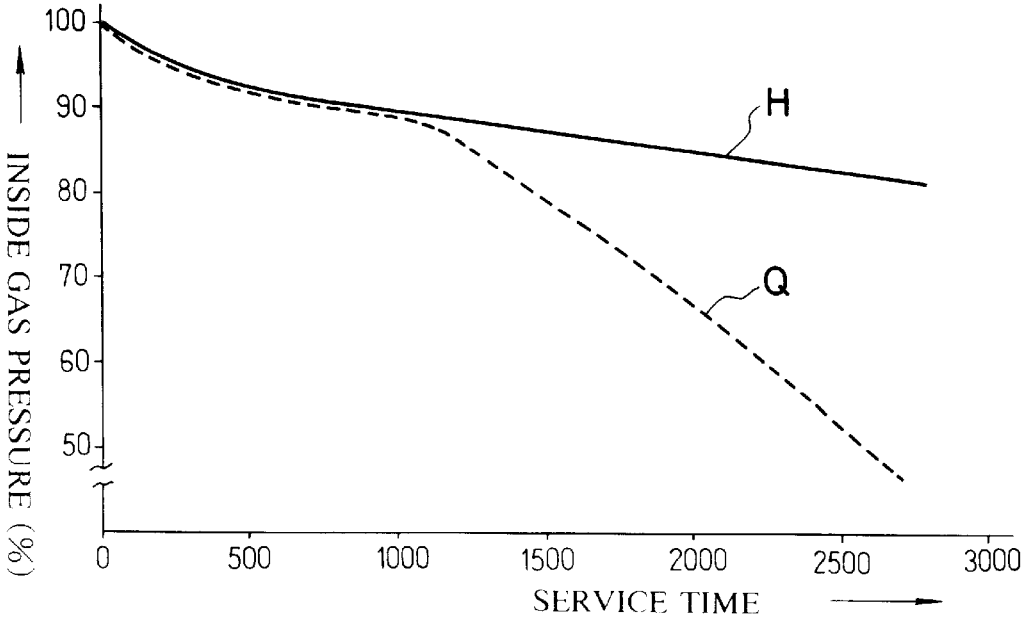
FIG. 3 is a graph showing service time vs. the brightness reduction characteristic of a neon discharge lamp according to the present invention as compared to a conventional neon discharge lamp.
Figure 4:
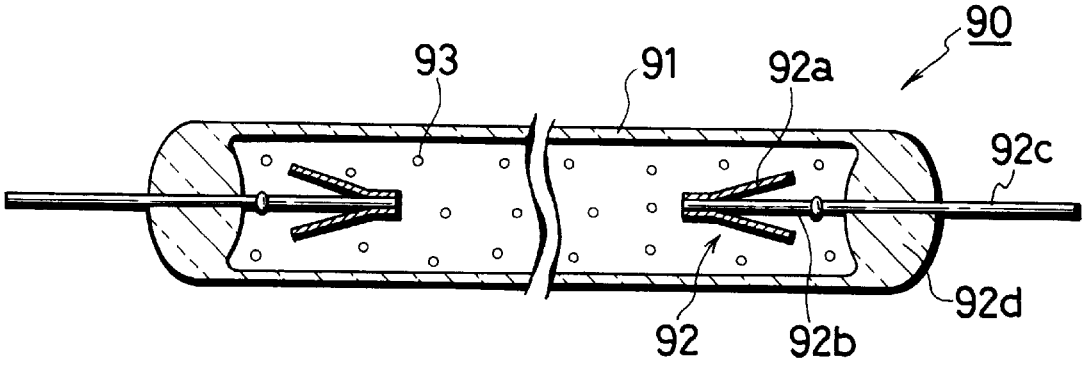
Fig.4 Prior Art
FIG. 4 is a cross-sectional view showing a conventional neon discharge lamp.
Figure 5:
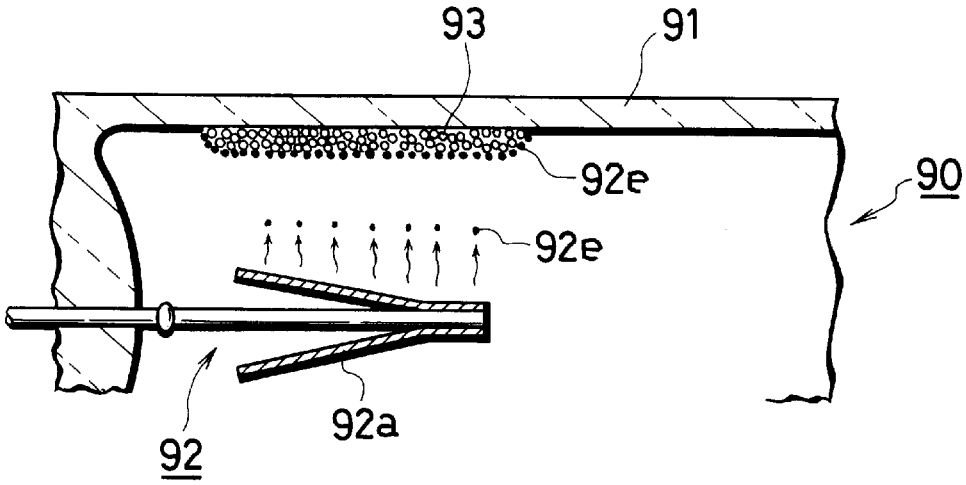
Fig.5 Prior Art
FIG. 5 is an explanatory drawing showing the neon gas encompassment owing to the cathode sputtering encountered in the conventional neon discharge lamp.

FIG. 3 illustrates the characteristic H of the reduction of the inside gas pressure relative to the service time of the neon discharge lamp 1 according to the present invention as compared to that (Q) of a conventional neon discharge lamp. Comparison between H and Q shows almost no significant difference until 1000 hours in the service time have passed. However, in the case of the characteristic Q of the conventional neon discharge lamp, the inside gas pressure reduces abruptly just after 1000 hours have passed. On the contrary, in the case of the characteristic H of the neon discharge lamp 1 according to the present invention, the inside gas pressure reduces slowly. The difference in the inside gas pressures between characteristics H and Q expands with the increase in the service time.

The reduction of the inside gas pressure of the conventional neon discharge lamp after 1000 hours of service time can be considered attributable to the neon gas encompassed by way of the aforementioned cathode sputtering. This because the varibles such as the kind of the gas, initially sealed inside gas pressure, the getter amount between the neon discharge lamp of the present invention and the conventional neon discharge lamp are designed in the same manner.

Since only the existence of the powder coatings 5 differentiate the lamp according to the present invention from the conventional lamp, it is apparent that the powder coatings 5 effectively eliminate the neon gas encompassment caused by way of the cathode sputtering. As described earlier the result of the experiment made by the inventors shows that the powder coatings 5 have sufficient action and effect when applied in the range just corresponding to the length of the electrode portions 3*a*. Accordingly, for example, even when the powder coatings 5 are applied throughout the tubular bulb 2, an extension of the operating life cannot be found which results in significant difference.

As described earlier, the powder coating with appropriate particle size is applied to the inside of the tubular bulb of the neon discharge lamp according to the present invention in the range nearly equal to or more the length of the electrode parts, along the axis of the tubular bulb. This powder coating, by virtue of its porous is characteristic, provides the neon discharge lamp of this kind with excellent effects toward improved performance and increased reliability; i.e. it prevents the phenomenon of neon gas being encompassed by way of the cathode sputtering, Prevents the operating life of the neon discharge lamp from being shortened, and permits a longer operating life.

In addition, luminescent materials that have commonly been used to coat inside the luminescent lamp over the years can be employed as the powder coating used according to the present invention. This gives great benefit of facilitating implementation to manufacturers of the neon discharge lamp of this kind; they can implement this powder coatings based on past experience and techniques without the need for preliminary investigation or preliminary study on relevant processes.

While the presently preferred embodiment of the present invention has been shown and described, it will be understood that the present invention is not limited thereto, and that various changes and modifications may be made by those skilled in the art without departing from the scope of the present invention as set forth in the appended claims.

What is claimed is:

1. A neon discharge lamp comprising:

a tubular bulb;

a pair of electrodes disposed at respective ends of said tubular bulb, said electrodes each producing sputtered particles during operation of said neon discharge lamp, each of said sputtered particles having a sputtered particle size; and a coating disposed on a portion of the inside of said tubular bulb, said coating having particles of a particle size, each particle size being greater than said sputtered particle size;

wherein:

said tubular bulb has a longitudinal axis;

said coating is disposed on said inside of said tubular bulb along said longitudinal axis at portions of said longitudinal axis which correspond to a location of each of said electrodes within said discharge lamp; and wherein said coating extends at said portions on said inside of said tubular bulb for a length which is approximately equal to a length of each of said electrodes.

2. A neon discharge lamp comprising:

a tubular bulb;

a pair of electrodes disposed at respective ends of said tubular bulb, said electrodes each producing sputtered particles during operation of said neon discharge lamp, each of said sputtered particles having a sputtered particle size; and a coating disposed on a portion of the inside of said tubular bulb said coating having particles of a particle size each particle size being greater than said sputtered particle size;

wherein:

said tubular bulb has a longitudinal axis;

said coating is a powder coating of a luminescent material used to coat a luminescent lamp;

said coating is disposed on the said inside of said tubular bulb along said longitudinal axis at portions of said longitudinal axis which correspond to a location of each of said electrodes within said discharge lamp; and wherein said coating extends at said portions on said inside of said tubular bulb for a length which is approximately equal to a length of each of said electrodes.

3. A neon discharge lamp comprising:

a tubular bulb;

pair of electrodes disposed at respective ends of said tubular bulb, said electrodes each producing sputtered particles during operation of said neon discharge lamp, each of said sputtered particles having a sputtered particle size; and a coating disposed on a portion of the inside of said tubular bulb, said coating having particles of a particle size, each particle size being greater than said sputtered particle size, said particle size of said particles of said coating being between approximately 5 $\mu$m to approximately 10 $\mu$m;

wherein:

said tubular bulb has a longitudinal axis;

said coating is disposed on said inside of said tubular bulb along said longitudinal axis at portions of said longitudinal axis which correspond to a location of each of said electrodes within said discharge lamp; and wherein said coating extends at said portions on said inside of said tubular bulb for a length which is approximately equal to a length of each of said electrodes.

4. A neon discharge lamp comprising:

a tubular bulb;

a pair of electrodes disposed at respective ends of said tubular bulb, said electrodes each producing sputtered particles during operation of said neon discharge lamp, each of said sputtered particles having a sputtered particle size; and a coating disposed on a portion of the inside of said tubular bulb, said coating having particles of a particle size, each particle size being greater than said sputtered particle size, said particle size of said particles of said coating being between approximately 5 $\mu$m to approximately 10 $\mu$m;

wherein:

said tubular bulb has a longitudinal axis;

said coating is disposed on said inside of said tubular bulb along said longitudinal axis at portions of said longitudinal axis which correspond to a location of each of said electrodes within said discharge lamp; and wherein said coating extends at said portions on said inside of said tubular bulb for a length which is approximately equal to a length of each of said electrodes; and wherein said coating is a powder coating of a luminescent material used to coat a luminescent lamp.

5. A neon discharge lamp comprising:

a tubular bulb having a longitudinal axis;

a pair of electrodes disposed at respective ends of said tubular bulb; and a coating disposed on an inside of said tubular bulb along said longitudinal axis at portions of said longitudinal axis which correspond to a location of each of said electrodes within said discharge lamp; and wherein said coating extends at said portions on said inside of said tubular bulb for a length which is approximately equal to a length of each of said electrodes.

* * * * *

UNITED STATES PATENT AND TRADEMARK OFFICE

CERTIFICATE OF CORRECTION

PATENT NO. : 6,104,133
DATED : August 15, 2000
INVENTOR(S) : Aizawa et al.

It is certified that error appears in the above-identified patent and that said Letters Patent is hereby corrected as shown below:

Title page, item
[73] should read -- Stanley Electric Co., Ltd. of Tokyo, Japan--

Signed and Sealed this

First Day of May, 2001

*Attest:*

Nicholas P. Godici

NICHOLAS P. GODICI

*Attesting Officer*

*Acting Director of the United States Patent and Trademark Office*